United States Patent [19]

Griffith

[11] 4,081,299

[45] Mar. 28, 1978

[54] AQUEOUS EXPLOSIVE SLURRIE WITH INORGANIC PEROXIDE SENSITIZER

[75] Inventor: George L. Griffith, Coopersburg, Pa.

[73] Assignee: IMC Chemical Group, Inc., Terre Haute, Ind.

[21] Appl. No.: 768,237

[22] Filed: Feb. 14, 1977

[51] Int. Cl.[2] ..... C06B 33/14

[52] U.S. Cl. ..... 149/41; 149/43; 149/44; 149/60; 149/61

[58] Field of Search ..... 149/41, 43, 44, 60, 149/61

[56] References Cited

U.S. PATENT DOCUMENTS

| | | | |
|---|---|---|---|
| 3,485,686 | 12/1969 | Jessop et al. | 149/44 X |
| 3,574,011 | 4/1971 | Knight | 149/44 X |
| 3,617,401 | 11/1971 | Mortensen et al. | 149/2 |

*Primary Examiner*—Stephen J. Lechert, Jr.

*Attorney, Agent, or Firm*—Edward A. Figg; Howard E. Post

[57] ABSTRACT

Improved explosive slurries of the type containing an oxidizing salt, an organic fuel, a metallic fuel, a thickening agent, and water, wherein the improvement includes a sensitizing amount of an inorganic peroxide.

4 Claims, No Drawings

AQUEOUS EXPLOSIVE SLURRIE WITH INORGANIC PEROXIDE SENSITIZER

BACKGROUND OF THE INVENTION

This invention relates to improved explosive slurries. More particularly, the invention relates to thickened explosive slurries of the type containing an oxidizing salt, an organic fuel, aluminum, a thickening agent, and water.

Aqueous explosive slurries are well known in the explosives art and have been widely accepted by users of commercial explosives. Such explosives generally contain a wide variety of ingredients. For instance, a slurry usually contains an inorganic oxidizing salt such as ammonium nitrate or an alkali or alkaline earth metal nitrate, e.g. sodium nitrate, potassium nitrate, calcium nitrate, etc., corresponding perchlorate salts, or mixtures thereof. Organic fuels are also utilized in such slurries. Suitable organic fuels include a large variety of finely divided non-explosive carbonaceous materials such as carbon black, ground coal, fuel oils, vegetable oils, wax, wood pulp, vegetable pulp, sugar, nut meal, bagasse, etc. The explosive power and sensitivity of explosives is further enhanced by the use of a metallic fuel. Such fuels include finely divided light metals and light metal alloys, e.g. aluminum, magnesium, boron, etc., and alloys thereof.

Depending upon the type of blasting agent desired, explosive slurries may optionally contain high explosive ingredients. Such ingredients include, for instance, the highly explosive materials, nitrostarch, trinitrotoluene (TNT), pentaerythritol tetranitrate (PETN), nitrocellulose, cyclotrimethylene trinitramine (RDX) and mixtures thereof. Slurries containing explosive ingredients are generally more powerful and more sensitive to detonation than those which to not contain such ingredients.

Aqueous explosive slurries are advantageously thickened or gelled. Thickening serves to prevent segregation of the ingredients, to prevent leaks from containers having small perforations, to inhibit evaporation of liquid ingredients, and to provide resilient products when filled into elastic casings. The slurries are conventionally thickened with water-soluble polysaccharides, e.g. carboxy methyl cellulose, natural starches, and gums. Galactomannan gums, particularly guar gum, have been preferred for this purpose. Such gums cause slurries to gel if employed in sufficiently high concentrations, and cross-linking agents such as polyvalent inorganic salts, e.g. sulfate, nitrate, chromate, or chloride salts of chromium, iron, aluminum, zinc, potassium, or tin or a water-soluble pentavalent antimony compound, such as potassium pyroantimonate, may be added to enhance gel formation.

Although aqueous explosives have found wide acceptance and have many advantages over other types of explosives, their manufacture presents certain unique problems. One such problem has been that slurries tend to lose sensitivity to detonation upon mixing. Although the exact cause of this loss of sensitivity is not known, one theory is that it is the result of mechanical removal of air bubbles which are normally present on the surface of the particles of the metallic fuel. Accordingly, a need exists for a means for maintaining the sensitivity of explosive slurries during mixing and filling operations.

SUMMARY OF THE INVENTION

An object of the present invention is to provide an improved explosive slurry. Another object is to provide an improved explosive slurry of the type containing an oxidizing salt, an organic fuel, a metallic fuel, a thickening agent, and water. A third object is to provide such slurries which maintain their sensitivity during mixing and filling operations. Other objects and advantages will be apparent to those skilled in the art from the disclosure herein.

In accordance with the invention, there is disclosed an improved explosive slurry of the type containing an oxidizing salt, an organic fuel, a metallic fuel, a thickening agent, and water, wherein the improvement comprises a sensitizing amount of an inorganic peroxide.

DETAILED DESCRIPTION OF THE INVENTION

It has been discovered that the addition of an inorganic peroxide to an explosive slurry containing a metallic fuel, counteracts the desensitizing effect which mixing generally has on such slurries. The inorganic peroxides used in the improved slurries may be hydrogen peroxide or alkali metal peroxides, e.g. sodium peroxide, potassium peroxide, lithium peroxide, etc. The preferred inorganic peroxide for the practice of this invention is hydrogen peroxide.

The inorganic peroxide is generally employed in a sensitizing amount. A sensitizing amount is a cncentration sufficient to provide a slurry which has approximately the same or greater sensitivity to detonation after mixing or filling operations than it had before such operations. The desired sensitivity will vary with various types of explosive slurries. For instance, for slurries containing high explosive ingredients, sensitivity to detonation with a conventional blasting cap may be desired, whereas, detonation with a booster or primer may be necessary for slurries which do not contain high explosive ingredients. A concentration of inorganic peroxide of from about 0.005 wt. % to about 0.5 wt. % of the slurry is generally a sensitizing amount. The preferred concentration of inorganic peroxide is from about 0.01 wt. % to about 0.25 wt. %.

The explosive slurries of the present invention advantageously comprise the following ingredients at the indicated approximate concentrations:

| | Wt. % |
|---|---|
| Oxidizing Salt | 20–75 |
| Organic Fuel | 1–20 |
| Metallic Fuel | 1–10 |
| Thickening Agent | 0.1–5 |
| High Explosive | 0–50 |
| Water | 5–40 |
| Inorganic Peroxide | 0.005–0.5 |

The preferred oxidizing salt is ammonium nitrate or a mixture of ammonium nitrate and an alkali metal nitrate or an alkaline earth nitrate preferably sodium nitrate or calcium nitrate. As hereinbefore stated, suitable organic fuels include a wide variety of non-explosive carbonaceous materials. Preferred organic fuels are sugar, carbon black, ground coal, and nut meal. The preferred metallic fuel is finely divided aluminum, e.g. flake aluminum. Guar gum in combination with a crosslinking agent selected from the group consisting of potassium dichromate, zinc dichromate, and potassium pyroantimonate, is the preferred thickening agent. Nitrostarch is the preferred high explosive ingredient, if such is employed in the slurry.

Various additional ingredients, familiar to those skilled in the art, may be employed in the explosive slurries of this invention. Such ingredients may include an antacid, such as zinc oxide, calcium carbonate, etc., a stabilizer such as sodium thiosulfate, and additional sensitizers, such as air-entrapping materials, e.g. hollow glass or plastic microspheres.

A preferred explosive slurry may comprise the following ingredients at the indicated approximate concentrations:

| | Wt. % |
|---|---|
| Ammonium Nitrate | 30–50 |
| Sodium Nitrate | 5–15 |
| Calcium Nitrate | 5–15 |
| Corn Sugar | 2–10 |
| Ground Coal | 0.1–5 |
| Carbon Black | 0.01–2 |
| Aluminum | 2–7 |
| Hollow Glass Microspheres | 0.01–3 |
| Nitrostarch | 0–25 |
| Water | 10–30 |
| Hydrogen Peroxide | 0.01–0.2 |

It is thus apparent that there have been provided improved explosive slurries which satisfy the objectives, aims and advantages set forth above. Although the invention has been described in conjunction with explosive slurries containing certain ingredients, it is not intended to be limited to such slurries but is intended to broadly embrace all aqueous explosive slurries which fall within the spirit and broad scope of the appended claims.

The invention is further illustrated by the following examples but is not intended to be limited thereby.

EXAMPLE I

Two aqueous slurry explosives (designated A and B) were prepared by blending the following ingredients at the indicated concentrations:

| Ingredient | A Wt. % | B Wt. % |
|---|---|---|
| $Ca(NO_3)_2$ | 4.76 | 4.76 |
| $Mg(NO_3)_2$ | 4.29 | 4.29 |
| ZnO | 0.8 | 0.8 |
| Nitrostarch (from 23% aqueous slurry) | 21.6 | 21.6 |
| Corn Sugar | 6.0 | 6.0 |
| Ammonium Nitrate | 29.5 | 29.5 |
| Sodium Nitrate | 10.0 | 10.0 |
| Hollow Glass Microspheres | 1.0 | 1.0 |
| Sodium Thiosulfate | 0.4 | 0.4 |
| Hydrogen Peroxide (from 3% aqueous solution) | 0.03 | — |
| Aluminum | 5.0 | 5.0 |
| Hydroxy Propylated Guar Gum | 0.15 | 0.15 |
| Guar Gum | 1.0 | 1.0 |
| Zinc Chromate | 0.1 | 0.1 |

-continued

| Ingredient | A Wt. % | B Wt. % |
|---|---|---|
| Water | 15.37 | 15.40 |

Each slurry was mixed for 15 minutes until all ingredients were suspended. Portions of both slurries were packed into 1½ inches diameter tubing and were tested for sensitivity. Both were sensitive to detonation with an A-4 blasting cap. The slurries were allowed to stand for 2½ hours until they were quite viscous. They were then agitated for 10 minutes to cause sheering of the aluminum and portions were again packed into 1½ inches diameter tubing and tested for sensitivity to detonation. Slurry A was sensitive to detonation with an A-1 blasting cap, but Slurry B required an A-4 blasting cap for detonation.

EXAMPLE II

The experiment of Example I is repeated in all essential details except that sodium peroxide is substituted for hydrogen peroxide. The sodium peroxide-containing slurry should retain its sensitivity during mixing and filling.

EXAMPLE III

The experiment of Example II is repeated in all essential details except lithium peroxide is substituted for hydrogen peroxide. The lithium peroxide-containing slurry should retain its sensitivity during mixing and filling.

I claim:

1. An improved explosive slurry of the type containing an oxidizing salt, an organic fuel, a metallic fuel, a thickening agent, and water, wherein the improvement consists essentially of a sensitizing amount of an inorganic peroxide.

2. The explosive slurry of claim 1 wherein the inorganic peroxide is selected from the group consisting of hydrogen peroxide and alkali metal peroxides and is present at a concentration of from about 0.005 wt. % to about 0.5 wt. %.

3. The explosive slurry of claim 1 wherein the inorganic peroxide is hydrogen peroxide and is present at a concentration of from about 0.01 wt. % to about 0.25 wt. %.

4. The explosive slurry of claim 3 wherein the oxidizing salt is ammonium nitrate or a mixture of ammonium nitrate and sodium nitrate at a concentration of from about 20 wt. % to about 75 wt. %; the organic fuel is selected from the group consisting of carbon black, ground coal, fuel oil, vegetable oil, wax, wood pulp, vegetable pulp, sugar, nut meal, and bagasse, at a concentration of from about 1 wt. % to about 20 wt. %; the metallic fuel is aluminum at a concentration of from about 1 wt. % to about 10 wt. %; the thickening agent is guar gum at a concentration of from about 0.1 wt. % to about 5 wt. %; and the water is present at a concentration of from about 5 wt. % to about 40 wt. %.

* * * * *